US009550957B2

(12) United States Patent
Gandon et al.

(10) Patent No.: US 9,550,957 B2
(45) Date of Patent: Jan. 24, 2017

(54) FUNCTIONAL FLUIDS COMPRISING ALKYL TOLUENE SULFONATES

(71) Applicant: Chevron Oronite Company LLC, San Ramon, CA (US)

(72) Inventors: Christine Gandon, Montivilliers (FR); Gilles P. Sinquin, St. Martin due Manoir (FR); Pierre Tequi, Breaute (FR); Stephanie Palotiai, Beuzeville (FR); Michael Shrout, Oakley, CA (US)

(73) Assignee: CHEVRON ORONITE COMPANY LLC, San Ramon, CA (US)

( * ) Notice: Subject to any disclaimer, the term of this patent is extended or adjusted under 35 U.S.C. 154(b) by 0 days.

(21) Appl. No.: 14/842,119

(22) Filed: Sep. 1, 2015

(65) Prior Publication Data

US 2015/0368581 A1 Dec. 24, 2015

Related U.S. Application Data

(63) Continuation of application No. 13/200,280, filed on Sep. 22, 2011, now abandoned, which is a continuation of application No. 11/562,027, filed on Nov. 21, 2006, now abandoned.

(51) Int. Cl.

| | |
|---|---|
| ***C10M 141/08*** | (2006.01) |
| ***C10M 159/24*** | (2006.01) |
| ***C10M 135/10*** | (2006.01) |

(52) U.S. Cl.

CPC ..... *C10M 141/08* (2013.01); *C10M 159/24* (2013.01); *C10M 2203/1006* (2013.01); *C10M 2219/044* (2013.01); *C10M 2219/046* (2013.01); *C10N 2210/01* (2013.01); *C10N 2210/02* (2013.01); *C10N 2220/02* (2013.01); *C10N 2220/027* (2013.01); *C10N 2220/028* (2013.01); *C10N 2230/06* (2013.01); *C10N 2240/04* (2013.01); *C10N 2240/042* (2013.01); *C10N 2240/044* (2013.01); *C10N 2240/08* (2013.01)

(58) Field of Classification Search

CPC ..... C10M 141/08; C10M 159/24; C10M 2203/1006;C10M 2219/044; C10M 2219/046; C10N 2210/01; C10N 2210/02; C10N 2220/02; C10N 2220/027; C10N 2220/028; C10N 2230/06; C10N 2240/04; C10N 2240/042; C10N 2240/044; C10N 2240/08

USPC ..... 508/391, 459, 390

See application file for complete search history.

(56) References Cited

U.S. PATENT DOCUMENTS

| | | | |
|---|---|---|---|
| 3,259,583 | A | 7/1966 | Sprague et al. |
| 3,410,801 | A | 11/1968 | Tunkel et al. |
| 3,451,930 | A | 6/1969 | Mead |
| 3,634,258 | A | 1/1972 | Bickham et al. |
| 3,899,432 | A | 8/1975 | Rothert et al. |
| 3,920,562 | A | 11/1975 | Foehr |
| 3,933,659 | A | 1/1976 | Lyle et al. |
| 4,253,977 | A | 3/1981 | O'Halloran |
| 4,259,193 | A | 3/1981 | Tirtiaux et al. |
| 5,652,201 | A | 7/1997 | Papay et al. |
| 5,939,594 | A | 8/1999 | Le Coent |
| 6,054,419 | A | 4/2000 | Le Coent |
| 6,337,310 | B1 | 1/2002 | Campbell |
| 6,479,440 | B1 | 11/2002 | Le Coent |
| 6,803,350 | B2 | 10/2004 | Lanuejoul et al. |
| 7,012,045 | B2 | 3/2006 | Aoyagi et al. |
| 2001/0034307 | A1 | 10/2001 | King et al. |

FOREIGN PATENT DOCUMENTS

| | | |
|---|---|---|
| EP | 0881277 | 12/1998 |
| EP | 731072 | 6/1999 |
| EP | 1160309 | 12/2001 |
| JP | 2008319494 | 12/1996 |
| JP | 2003502452 | 1/2003 |
| JP | 2007268375 | 10/2007 |
| JP | 2008311015 | 12/2008 |
| WO | 0077015 | 12/2000 |

*Primary Examiner* — James Goloboy

(74) *Attorney, Agent, or Firm* — Ryan, Mason & Lewis, LLP

(57) ABSTRACT

Provided are formulations, methods of making, and methods of using a functional fluid of the present invention to achieve and maintain optimal frictional characteristics in machines housing that fluid, wherein the functional fluid comprises, among others, a friction-modifying amount of an alkyl toluene sulfonate salt or a mixture of alkyl toluene sulfonate salts.

24 Claims, No Drawings

FUNCTIONAL FLUIDS COMPRISING ALKYL TOLUENE SULFONATES

PRIORITY

This application is a continuation of co-pending U.S. patent application Ser. No. 13/200,280 filed Sep. 22, 2011, now abandoned, which is a continuation of U.S. patent application Ser. No. 11/562,027, filed Nov. 21, 2006, now abandoned, the contents of which are incorporated herein by reference.

The present invention, relates to functional fluid compositions suitable for use in systems and machines comprising relatively moving and coupling parts. In particular, the present invention relates to functional fluid compositions suitable for use in heavy machinery, especially in high-power-output tractors, transmissions, hydraulics, and the like. The present invention, further pertains to a new and improved class of friction modifying agent that can be used to render such favorable frictional characteristics to functional fluids. Moreover, the present invention is concerned with methods of providing optimal frictional characteristics to machines housing the functional fluids and maintaining such characteristics therein. Furthermore, the present invention relates to the methods of preparing such functional fluid compositions.

The term "functional fluids" encompasses various types of fluids, including for example, tractor fluids, automatic transmission fluids, manual transmission fluids, hydraulic fluids, power steering fluids, fluids for use with power-train components, as well as fluids of various other capacities. These fluids typically do more than merely lubricating the machines that house them. Rather, they provide one or more functionalities other than, or in most cases, in addition to, lubricity. The additional functionalities may enable the machines to operate more effectively and/or efficiently. Therefore, functional fluids tend to be multi-functional fluids, although at least one of their functions is typically related to providing lubrication to the machine components immersed therein.

The several functions and characteristics of the functional fluids are bestowed upon the functional fluids by additives. Typical additives for functional fluids may include, for example, viscosity index improvers, oxidation inhibitors, corrosion/rust inhibitors, dispersants, pour point depressants, foam inhibitors, demulsifiers, antiwear agents, seal swellants, friction modifiers, and others. The present invention relates to a new class of friction modifiers.

Although persons skilled in the art often use the terms "friction modifying agent" and "friction modifier" interchangeably, for the purpose of the present invention, a friction modifying agent may refer to a material that is other than a conventional friction modifier. Rather, the term "friction modifying agent" refers to any agent that modifies or affects the friction properties of a fluid to which it is a part. The textbook, *Lubricant Additives, Chemistry & Applications*, Rudnick, ed. (Marcel Decker Inc., New York) (2003), defines friction at page 204, as "the resistance a body meets while moving over another body in respect of transmitting motion." In conventional lubricating oil compositions, friction modifiers are known to simply reduce the friction between surfaces that come into contact with each other during operation, thus reducing wear to these surfaces. Specifically, as the surfaces move closer together, the lubricant is squeezed out between them. During this process, the friction modifiers in the lubricant become adsorbed onto the surfaces, thereby retained between the surfaces, displaying a molecular orientation perpendicular to the surfaces to reduce the level of contact and lower the friction. In comparison, friction modifying agents typically do more than reducing friction in functional fluids. These fluids are used with relatively moving and coupling parts that axe at least partially immersed therein. These fluids thus must keep the friction levels at an optimal level, sufficiently low to prevent excessive wear and tear, but also sufficiently high so that the relatively moving and coupling parts may accurately engage and disengage without slippage.

Functional fluids are therefore formulated to meet both the operational and the lubrication needs of the machines. For example, tractor fluids are used to lubricate the transmissions, gears, bearings, hydraulics, power steering components, mechanical power takeoffs, and oil-immersed brakes in machines driven by tractors. When a functional fluid is used to lubricate the hydraulics in a tractor, it may also be called a tractor hydraulic fluid. Used in a tractor, a functional fluid may provide for brake capacity, engagement and disengagement of power takeoff clutches, and transfer and dissipation of heat generated during operation. In modern tractors, power brakes can either be of the drum-type or the disc-type, hut the disc-type brakes are preferred because of their superior braking capacity. Further among the disc brakes, the wet-type or oil-immersed brakes are preferred because the functional fluids effectively isolate the brakes from dirt and grime. Despite these known advantages of wet disc brakes, they often suffer at least one prominent drawback, namely, brake chatter (also known as brake squawk). Brake chatter occurs where the torque variation of the friction material or reaction plate is so large as to create harmonic vibrations in the equipment. These vibrations usually lead to objectionable and unpleasant sounds being emitted from the equipment when brakes are applied.

To combat brake chatter, persons skilled in the art have, for example, added friction modifiers such as dioleylhydrogen phosphite to tractor fluids or tractor hydraulic fluids. Often, however, these conventional friction modifying agents would render the fluids unsuitable for use for various reasons. First, brake chatter is but one of the many issues that must be addressed when formulating a tractor fluid or a tractor hydraulic fluid. For example, the capacities of both the wet brakes and the power takeoff clutches are always considered. Conventional friction modifiers such as dioleyhydrogen phosphite, while effective in reducing the brake chatter, can be associated with an unacceptable simultaneous lowering or the brake and takeoff clutches capacities, making it more difficult to engage the clutches and/or bring the equipment to stop. Therefore, although a suitable friction modifying agent should reduce friction, it should only do so to a certain extent rather than as much as possible. The resulting friction level is preferably one at which a compromise is reached to minimize brake chatter while maintaining the brake/clutch capacities. Accordingly, a suitable tractor fluid or tractor hydraulic fluid would pass both a wet brake chatter test and a wet brake capacity test. Second, because many tractor parts other than the brake discs are exposed to the same fluid, a suitable tractor fluid or tractor hydraulic fluid would lubricate those non-brake parts and pin vide power and means to dissipate heat. As a result, many known friction modifiers cannot be used in tractors because of their inability to provide adequate lubrication to or otherwise protect the non-brake parts. For instance, fluids containing dioleylhydrogen phosphite are not used in tractors because the additive is known to give rise to high gear wear, particularly when the gears are used at high temperatures. Furthermore, an apt functional fluid for use in tractors must offer extreme-pressure properties and certain other capacities such as water-tolerance or filterability. Therefore, to qualify as a tractor fluid or tractor hydraulic fluid, a given, functional fluid must pass tests besides the wet brake chatter and capacity tests mentioned above. Such additional tests may include, for example, a spiral bevel test, and a straight spur gear test, each giving indications of extreme-pressure properties.

Transmission fluids constitute another prominent group of functional fluids. An automatic transmission comprises a turbine drive unit, a torque converter, and one or more friction brakes or clutches that are engaged and disengaged automatically by an intricate hydraulic control unit. A manual transmission comprises a similar set of components, but the one or more friction brakes or clutches are engaged and disengaged manually. A typical, but simplified clutch assembly comprises plain steel plates that come into contact with other steel plates, the latter plates being covered on both sides with a friction material, such as, for example, compressed paper impregnated with a resin. There are many similarities, between a clutch assembly of a transmission and a set of disc brakes of a tractor. For example, here the entire clutch assembly is immersed completely or partially in the transmission fluid, just as the disc brakes are immersed completely or partially in the tractor hydraulic fluid. Accordingly, like their tractor hydraulic fluids counterparts, transmission fluids are typically multi-functional fluids. They lubricate the gears and bearings, transfer heat, and provide the fluids for hydraulic control and power transfer. Specifically, a suitable transmission fluid provides sufficient friction for the clutch plates to transfer power, allowing the transmission to shift smoothly and allowing it to lock up during a shift from one speed to another within a certain specified period of time, but not too much friction to cause wear and tear of bearing surfaces and the clutch plates.

Several parameters are used by persons skilled in the art to evaluate compositions for suitability as transmission fluids. Those parameters can be used individually or in combination with each other. One of those parameters is static or breakaway torque ($T_s$), which measures the relative tendency of engaged parts such as clutch packs, to slip under load. $T_s$ is typically determined upon completion of certain predetermined cycles of dynamic torque evaluation sequence. The use of conventional friction modifiers in attempts to improve frictional stability may reduce this breakaway $T_s$ to levels that are too low, at which the relative tendency of engaged parts to slip under load become unacceptable. That slippage can impair the drivability and safety of the vehicle to which the transmission is a part. Another often-used parameter, the "lock-up," measures the tendency of the clutch to grab and release intermittently when operating at relatively low sliding clutch speeds at which the clutch pack is fully engaged, causing stick-slip or shudder in the automobile. Yet another parameter is the "break-in period," which measures the change in frictional performance over time. It is desirable to have a friction modifying agent that does not exhibit a break-in period or that has a very short break-in period. Persons skilled in the art also use other parameters, some of which are derived from the three parameters above, to assess the frictional characteristics of transmission fluids.

Further examples of functional fluids include, for example, hydraulic fluids, which embody a similar set of multi-faceted considerations. One type of hydraulic fluid is the tractor hydraulic fluid, which is discussed above along with various other functional fields suitable for use in tractors. Aside from the usual lubricant additives such as, for example, antioxidants, corrosion inhibitors, foam inhibitors, anti-wear agents, viscosity index improvers, pour point depressants, detergents and dispersants, and seal swellants, friction modifying agents are typically employed in these fluids to promote smooth and sticking- and/or slipping-free operation of the hydraulic systems. Indeed, hydraulic fluids typically require the inclusion of friction modifying agents to function properly. The need for friction modifying agents becomes especially acute when the relative motions between heavily-leaded mating surfaces are slow. This is because, as the relative speed between two contacting surfaces diminishes, the lubricant film thickness also decreases, resulting in increased physical contact, higher friction, and higher wear of the surfaces. Friction modifying agents are also typically used when there are exacting accuracy requirements for the coupling process, such as for example, in numerically controlled machine tools, or when the coupling surfaces are made of different materials. Moreover, the initial friction is usually high in hydraulic systems, because surface asperities must be lifted over one another until sufficient speed is achieved to establish a continuous hydrodynamic lubricating film that separates the coupling surfaces. Therefore, a suitable hydraulic fluid not only lubricates the hydraulic elements, but also achieves and maintains an optimal level of friction among the coupling surfaces so as to prevent uneven operation under various speeds, loads, and material combinations.

Accordingly, a suitable functional fluid would provide a level of friction that is neither too low for the accurate engagement and disengagement of relatively moving parts, nor too high so that there would be an unacceptable level of wear and tear. The present invention provides such a friction modifying agent, which imparts improved frictional characteristics to various functional fluids.

A typical friction modifying agent may be a long-chain molecule comprising a polar end group and a non-polar linear hydrocarbon chain. The polar end group either physically adsorbs onto a metal surface, chemically reacts with the surface, or otherwise attach to the surface, while the hydrocarbon chain extends into the functional fluid. Chains from multiple friction modifying molecules then link with one another and with the other components in the fluid to form a film on the metal surface.

Persons skilled in the art are aware that many friction modifiers suitable for use in conventional lubricating oils are often nonetheless unsuitable for use in functional fluids because the latter have more demanding functional and compatibility requirements. As discussed above, for use in functional fluids, a friction modifying agent must be capable of reducing friction, but only to a certain extent so as to achieve the least possible wear without sacrificing smooth and accurate operation. Furthermore, some conventional friction modifiers are known to chemically or physically interact with other additives that are necessarily or optionally included in the functional fluids, effectively competing with these other additives for occupation of the surfaces on the moving metal parts.

There have been sustained efforts in the art to develop new friction modifying agents suitable for use in various functional fluids. A few agents have been identified to date and some of those are described below. There nonetheless remains a significant need for alternatives and/or improvements.

A number of the friction modifiers identified as suitable for use in functional fluids are amines, amides, or other nitrogen-containing compounds, which would, among other things, raise the nitrogen content of the fluids and restrict their potential scopes of application as a result. For example, U.S. Pat. No. 3,634,256 disclosed an automatic transmission fluid containing (1) a friction modifier selected from the group consisting of oxyalkylated aliphatic tertiary amines, 1-hydroxyalkyl-2 alkyl imidazolines (e.g., 1-hydroxyethyl-2-heptacecyl-2-imidazoline) and mixtures thereof; and (2) an oil-soluble polyalkenyl substituted succinimide of an alkylene polyamine. U.S. Pat. No. 3,933,659 disclosed another automatic transmission fluid comprising a major amount of an oil of lubricating viscosity, and an effective amount of each of the following; (1) an alkenyl succinimide; (2) a Group II metal salt of a dihydrocarbyl dithiophosphoric acid; (3) a friction-modifying compound selected from the group consisting of (a) fatty acid esters of dihydric and other polyhydric alcohols, and oil soluble oxyalkylated derivatives thereof, (b) fatty acid amides of low molecular weight amino acids, (c) N-fatty alkyl-N,N-diethanol amines, (d) N-fatty alkyl-N,N-di-(ethoxyethanol) amines, (e) N-fatty alkyl-N,N-di-poly-(ethoxy) ethanol amines, and (f) mixtures thereof; and (4) a basic sulfurized alkaline earth metal alkyl phenate. This composition was indicated to be particularly suitable for use with automatic transmissions of passenger cars. More recently, U.S. Pat. No. 6,803,350 disclosed a tractor fluid comprising a friction-modifying amount of an oil-soluble fatty acid amide and a fatty acid ester derived from a polyhydric alcohol. That tractor fluid was said to exhibit good anti-chatter characteristics.

The art also taught the use of several metal salts of fatty hydrocarbyl sulfonates as friction modifiers in functional fluids. For example, U.S. Pat. No. 3,410,801 described a hydraulic fluid suitable for use in a wet clutch system comprising a friction-modifying amount of the reaction product of an overbased metal hydrocarbon sulfonate and a fatty acid. Recently, U.S. Pat. No. 7,012,045 disclosed the use of polyalkenyl sulfonates in functional fluids to provide improved brake and clutch capacity, wherein the polyalkenyl sulfonate was an alkali metal or alkaline earth metal salt of a polyalkene sulfonic acid derived from a mixture of polyalkenes comprising greater than about 20 mole percent alkyl vinylidene and 1,1-dialkyl isomers.

On occasion, aromatic hydrocarbyl sulfonate salts have been used to modify friction in certain functional fluids. For example, U.S. Pat. No. 3,451,930 taught a fluid for farm tractor transmissions composing a friction modifier that was a three-component mixture of (1) a metal salt of a hydrocarbon sulfonic acid, which may be a metal salt of an aromatic hydrosulfonic acid or a metal, salt of a non-aromatic hydrosulfonic acid; (2) a zinc salt of a dialkyl dithiophosphoric acid; and (3) a chlorinated paraffin wax. Moreover, U.S. Pat. No. 3,259,583 disclosed power transmission fluid consisting essentially of a major amount of a mineral lubricating oil, and a small amount of a friction modifier that was another three-component mixture of (1) an overbased alkaline earth metal petroleum sulfonate, which may be an aromatic sulfonate or a non-aromatic sulfonate; (2) a polyaryl polyamine having the formula:

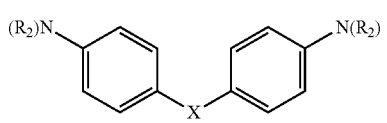

(I)

wherein X is oxygen, sulfur, or a methylene radical and R is a $C_1$ to $C_8$ alkyl radical such as methyl, ethyl, propyl, isopropyl, butyl, isobutyl, t-butyl, amyl, hexyl, octyl radical; and (3) a zinc salt of an unsaturated fatty acid having from 12 to 18 carbon atoms. According to that patent, all three parts must be included to affect the frictional characteristics of the fluid, because "none of these materials alone possess[es] anti-frictional properties and yet in combination they are excellent friction inhibitors." Column 1, lines 60-62.

On the other hand, aromatic hydrocarbon sulfonates such as alkyl aryl sulfonates have been widely applied as detergents or dispersants in functional fluids. For example, U.S. Pat. No. 3,899,432 disclosed a functional fluid comprising an oil of lubricating viscosity, and an effective amount of each of (1) Group II salt of hydrocarbyl sulfonic acid; (2) overbased group II metal salt of hydrocarbyl sulfonic acids; (3) Group II salt of dihydrocarbyl dithiophosphoric acid; (4) tricresyl phosphate; and (5) sulfurized mixture of olefins and fatty acid esters. The neutral sulfonate salts were said to provide improved water tolerance, detergency and dispersancy, whereas the overbased sulfonate salts were said to improve thermal stability, antioxidation, and rust inhibition. Similarly, U.S. Pat. No. 3,920,562 disclosed a functional fluid especially suitable for use as an automatic transmission fluid comprising a major amount of an oil of lubricating viscosity, and an effective amount of each of (1) an alkynyl succinimide; (2) a group II metal salt of a dihydrocarbyl dithiophosphoric acid; (3) a hydroxyl fatty acid ester of dihydroic or polyhydric alcohol or oil-soluble alkyoxylated derivatives thereof; and (4) a group II metal salt of a hydrocarbyl sulfonic acid "act[ing] as a detergent, and dispersant," to "prevent the deposit of contaminants formed during high temperature operation of the system containing the functional fluid." Column 7, line 66, to column 8, line 2. In yet another example, U.S. Pat. No. 4,253,977 disclosed a functional fluid with improved static friction behavior over extended period of time, comprising an overbased alkali or alkaline earth metal salt of a hydrocarbyl sulfonic acid, an alkyl phenate, or a sulfurized alkyl phenol as a detergent. That particular functional fluid composition also comprised a friction modifier that was either an alkyl or alkyenyl $C_4$ to $C_{10}$ dicarboxylic acid having about 6 to 30 carbon atoms, or the reaction product of long-chain dicarboxylic anhydride with an aldehyde/tris-hydroxymethyl aminomethane adduct.

Overbased alkyl aryl sulfonates were also known to impart improved compatibility, solubility, foaming properties, low color, and minimal skin formation, for example, in U.S. Pat. No. 6,479,440. A mixture of alkyl phenyl sulfonates of alkaline earth metals comprising 50 to 85% of linear mono-alkyl phenyl sulfonate and 15 to 50% of a heavy alkyl aryl sulfonate was reported to have good solubility, stable (i.e., no skin formation) at room temperature, and have otherwise good detergent/dispersant performance in U.S. Pat. No. 6,054,419. The heavy alkyl aryl sulfonates of that patent include two types: (1) dialkyl aryl sulfonates, wherein the two alkyl groups are both linear; and (2) mono or poly alkyl aryl sulfonates, wherein the alkyl substituents are branched chains of certain lengths. A slightly modified mixture of alkaline earth metal alkyl phenyl sulfonates was said to have improved characteristics as a detergent and/or dispersant in a companion European Patent Application No. 98401968.7. That modified mixture comprised 20 to 70% of a linear mono alkyl phenyl sulfonate and 30 to 80% of a branched mono alkyl phenyl sulfonate.

Alkyl aryl sulfonates have also found occasional use as load-capacity improvers. For example, U.S. Pat. No. 3,451,930 disclosed a high-load gear oil especially suitable for use in rear axles and tractor transmissions. The high-load formulation was developed following the unexpected finding that a combination of three components: (1) an alkaline earth metal salt of a hydrocarbon sulfonic acid having a molecular weight of about 400 to about 900; (2) a metal salt of a dialkyl dithiophosphoric acid; and (3) a chlorinated hydrocarbon; exerted a synergestic improvement in the load-carrying capacity.

We have found that certain alkyl toluene sulfonate salts possess desirable frictional properties and may serve as friction modifying agents in functional fluids. The alkyl toluene sulfonate salt or a mixture of these salts of the present invention may or may not be the only friction modifying agent in a particular functional fluid. For example, an alkyl toluene sulfonate salt or a mixture of salts of the present invention may be used as the sole friction modifying agent in a given functional fluid, or it may be used in conjunction with one or more other compatible friction modifiers to provide the desired level of friction for that particular fluid. The present invention provides such alkyl toluene sulfonates, as well as functional fluid compositions comprising these sulfonates. The present invention further provides methods for preparing these functional fluids and using them to affect the friction levels among relatively moving and coupling parts in certain machines.

SUMMARY

The present invention relates to a class of new and improved friction modifying agents suitable for use in functional fluids, especially in tractor fluids, tractor hydraulic fluids, transmission fluids, hydraulic fluids, and the like. Specifically, the friction modifying agents of the present invention comprise alkyl toluene sulfonate salts. In some embodiments of the present invention, the alkyl toluene sulfonate salts are prepared by first alkylating toluene with isomerized olefins, then sulfonating the alkylated toluenes, followed by the introduction of metal sources. The alkyl toluene sulfonate salts of the present invention and mixtures thereof provide improved frictional characteristics to the functional fluids. Furthermore, the friction-modifying capacity of the alkyl toluene sulfonate salts of the present invention is not substantially diminished by the presence of chloride ions, which are sometimes introduced into the functional fluids by, for example, certain viscosity modifiers used in the manufacturing processes. Thus, the functional fluids of the present Invention can be used in the presence of chloride ions.

The first aspect of the present invention pertains to a friction modifying agent suitable for use in a functional fluid. The friction modifying agent of this aspect comprises an alkyl toluene sulfonate salt.

The second aspect of the present invention pertains to a functional fluid composition with improved frictional properties comprising a friction modifying agent of the first aspect. The functional fluid of this aspect is especially suitable for use as a tractor fluid, a tractor hydraulic fluid, a transmission fluid, or a hydraulic fluid, but may also be used in other machines comprising relatively moving and coupling parts.

The third aspect of the present invention pertains to a functional fluid of the second aspect, comprising a friction modifying agent of the first aspect, the friction-modifying capacity of which is not substantially diminished in the presence of chloride ions.

The fourth aspect of the present invention pertains to a friction modifying agent of the first aspect, the friction-modifying capacity of which is not substantially diminished in the presence of chloride ions.

This invention, in its fifth aspect, provides a method of making a functional fluid of the second and third aspects.

In its sixth aspect, this invention also pertains to a method of providing and maintaining optimal levels of friction in machines comprising relatively moving and coupling parts by applying the functional fluid of the second or third aspect.

Persons skilled in the art will understand other and further objects, advantages, and features of the present invention by reference to the following description.

DETAILED DESCRIPTION

Various preferred features and embodiments are described below by way of non-limiting illustrations.

The present invention relates to a functional fluid composition comprising one or more alkyl toluene sulfonate salts as friction modifying agents. Specifically, the alkyl toluene sulfonate salts of the present invention are salts of oil-soluble alkyl toluene sulfonic acids. The alkyl toluene sulfonate salts of the present invention may be any type of metal salts, including alkaline earth metal salts, alkali metal salts, and the like. An exemplary group of alkyl toluene sulfonate salts of the present invention are calcium salts. Moreover, the salts of the present invention are often overbased salts, although neutral salts are also acceptable. The salts of the present invention may further be overbased with carbon dioxide. The one or more alkyl toluene sulfonate salts of the present invention may be derived from alkyl toluene alkylates that are the alkylation products of toluene and linear olefins. As if is understood by persons skilled in the art and for purpose of the present invention, the term "a linear olefin" refers to a non-cyclic olefin. Accordingly, the linear olefin used to alkylate the toluene can be branched or unbranched. Furthermore, the linear olefin used to alkylate the toluene can be either a single olefin or a mixture of olefins with varying numbers of carbon atoms. The single olefin and/or the olefins in the mixtures are preferably selected from $C_{18}$ to $C_{30}$ linear olefins. Regardless of the length of the chains, or whether the alkylating agent is a single olefin or a mixture, however, these olefins are, in some exemplary embodiments, isomerized prior to the alkylation step.

Unless otherwise specified, all percentages are in weight percent.

The Friction Modifying Agents

The friction modifying agents of the present invention comprise alkyl toluene sulfonate salts. These salts can be prepared from alkyl toluene precursors by methods described below.

1. The Alkyl Toluene Precursors

An alkyl toluene precursor of the present invention may be originally derived front a conventional Friedel-Crafts reaction that alkylates toluene with an olefin. An alkyl toluene precursor of the present invention may comprise an alkyl chain that is about 3 to about 50 carbon atoms long. Another alkyl toluene precursor of the present invention may comprise an alkyl chain that is about 10 to about 40 carbon atoms long. Yet another alkyl toluene precursor of the present invention may comprise an alkyl chain that is about 18 to about 30 carbon atoms long. The toluene ring may be linked to any position on the alkyl chain except for position 1 on the alkyl chain. As persons skilled in the art will appreciate, "position 1" on an alkyl chain refers to the carbon position at the end of the chain. On the other hand, the alkyl chain can be linked to the toluene ring at any carbon position, except for the position at which the methyl group of the toluene is attached.

The olefin that is used to alkylate the toluene can be a single olefin or a mixture of various olefins, although the latter is typically the alkylation agent of choice. Regardless whether a single olefin or a mixture is used to alkylate the toluene, the olefins are preferably isomerized. They may be isomerized prior to, during, or after the alkylation step, but are preferably isomerized prior to the alkylation step. At least about 0.5%, more preferably, about 1% to about 50%, and particularly preferably, about 1.5% to about 35% of the olefins in the alkylation agent are alpha olefins. In an exemplary friction modifying agent of the present invention, the alpha olefin content is about 10%. In another exemplary friction modifying agent of the present invention, the alpha olefin content is about 16%. On the other hand, the olefins in the alkylation mixture may be branched or unbranched, but are preferably not entirely unbranched. Preferably, about 5% to about 80% of the olefins are branched, more preferably, about 10% to about 60% of the olefins are branched, and particularly, about 14% to about 31% of the olefins are branched. In an exemplary friction modifying agent of the present invention, about 14% of the olefins in the mixed-olefin alkylation agent are branched. In another exemplary friction modifying agent of the present invention, about 25% of the olefins in the mixed-olefin alkylation agent are branched. In yet another exemplary friction modifying agent of the present invention, about 30% of the olefins in the mixed-olefin alkylation agent are branched.

Methods of isomerizing olefin are known. Persons skilled in the art typically use one of at least two types of acidic catalysts for this purpose. Specifically, the acidic catalysts can be solid or liquid. A number of known solid acidic catalysts may be suitable, but a solid catalyst having at least one metal oxide is preferred. The metal oxide can be one selected from: natural zeolites, synthetic zeolites, synthetic molecular sieves, and clays. Preferably, the solid acidic catalyst comprises the acid forms of an acidic clay, or an acidic molecular sieve, or a zeolite having an average pore size of at least 6.0 angstroms. Useful acidic clays, including, for example, montmorillonite, laponite and saponite, may be derived from naturally-occurring or synthetic materials. Pillared clays may also serve as alleviation catalysts. Other molecular sieves with one-dimentional pore systems, having average pore sizes of less than 5.5 angstroms, may also serve as acidic catalysts. Examples include SM-3, MAPO-11, SAPO-11, SSZ-32, ZSM-23, MAPO-39, SAFO-39, ZSM-22, SSZ-20, ZSM-35, SUZ4, NU-23, NU86, and natural or synthetic ferrierites. These catalysts are described, tor example, in Handbook of Molecular Sieves by Rosamarie Szoslak (New York, Van Norsrand Reinhold, 1992), and in U.S. Pat. No. 5,282,858, which are hereby incorporated by reference.

The isomerization process can be carried out, for example, at temperatures ranging from about 50° C. to about 280° C. Because olefins tend to have high boiling points, the process is preferably carried out in the liquid phase, in batch or continuous mode. In the batch mode, a stirred autoclave or glass flask, which may be heated to the desired reaction temperature, is typically used. On the other hand, a continuous process is most efficiently carried out in a fixed-bed process. In a fixed-bed process, space rates, which measure the rates of contact between the reactants and the catalyst beds, can range from about 0.1 WHSV to about 10 or more WHSV (i.e., weight of reactant feed per weight of catalyst per hour). The catalyst is charged into the reactor, which can be heated to the desired reaction temperature. The olefin can also be bested before it is exposed to the catalyst bed. An exotherm of about 10° C. to about 15° C. is often observed along the catalyst bed. The reactor effluent containing partially-branched and isomerized olefin is then collected. In both batch and continuous modes, the resulting partially-branched and isomerized olefin mixture typically contains a certain olefin distribution (alpha-olefin, beta-olefin, internal-olefin, trisubstituted olefin and vinylidene-olefin) and branching content, which can be differentiated from the non-isomerized olefin.

Persons skilled in the art are able to choose isomerization conditions under which particular levels of isomerization may be achieved. Specifically, the level of isomerization is typically characterized by the amount of alpha olefins and the level of branching in a particular olefin sample or mixture. The amount of alpha olefin and the level of branching can in tarn be determined using various conventional methods, including, for example, Fourrier Transformed Infra Red (FTIR) spectroscopy. In a typical FTIR spectroscopy method, the level (or percentage) of alpha olefins can be measured by following the absorbance of a particular sample at 910 $cm^{-1}$ and comparing it to the 910-$cm^{-1}$ absorbance of calibration samples with known alpha olefin levels. The level (or percentage) of alpha olefin in the calibration samples can be obtained, for example, from $^{13}C$ quantitative nuclear magnetic resonance (NMR) spectroscopy according to known protocols.

The percentage of branching can also be measured by FTIR spectroscopy by following the absorbance of a sample at 1378 $cm^{-1}$. This absorbance corresponds to the extent of deformation vibration of methyl groups. The absorbance of an isomerized olefin sample is then compared to the 1378-$cm^{-1}$ absorbance of a set of calibration samples with known branching levels. Typically, a particular olefin mix to be tested is first hydrogenated, converting the unbranched portion to n-alkanes and the branched portion to branched alkanes. Gas chromatography is then used to distinguish the unbranched n-alkanes from the branched alkanes, the proportion of which correlates to the percent branching level in that olefin mix.

To achieve the desired levels of isomerization in a particular olefin mixture, a person skilled in the art can also mix olefins of different but known isomerization levels. For example, the skilled person may mix 8 portions of a 45%-branched olefin mix A comprising 15% alpha olefins, with 2 portions of a 25%-branched olefin mix B comprising 5% alpha olefins, to achieve a mixture AB that is 41%-branched and comprising 13% alpha-olefins.

As described above, the olefins used to alkylate toluene in the present invention comprise at least about 0.5%, more preferably, about 1% to about 50%, and particularly preferably, about 1.5% to about 35%, alpha olefins. Suitable olefins in this regard may be about 5% to about 80% branched, more preferably, about 10% to about 60% branched, and particularly preferably, about 14% to about 31% branched.

The alkylation step of the present invention may take place prior to, simultaneously with, or after, the isomerization step. It is however preferred that the isomerization step occurs before the alkylation step, so that the olefins that are used to alkylate toluene comprise isomerized olefins.

Various known alkylation methods can be used to make the alkyl toluene precursors. For example, a typical alkylation reaction, which takes place in the presence of a hydrogen fluoride catalyst, may competently serve this purpose. A high toluene-to-olefin charge/molar ratio, for example, at about 10, is used in a single reactor in order to increase the alkylation rate vs. isomerization and dimerization rate, yielding a reaction product that comprises a high level of monoalkyl toluene. Various other methods can also be used to achieve alkylation, but nearly always, a one-stage reactor is used as the preferred vessel in which the reaction would take place.

The alkylation process typically takes place at a temperature ranging from about 20° C. to about 250° C. Similar to the isomerization process discussed above, the alkylation process is preferably carried out in a liquid phase to accommodate the liquid olefins at these temperatures. The alkylation process may be activated in batch or continuous mode, with the former mode being carried out in a heated and stirred autoclave or glass flask, and with the latter mode carried out in a fixed-bed process.

In the fixed bed process, the catalyst is heated to the desired reaction temperature, for example, at about 100° C. to about 200° C. Pressure is increased by means of a back pressure valve so that, the pressure is above the bubble point pressure of the toluene at the reaction temperature. After pressurizing the system to the desired pressure, the temperature is then increased to the desired reaction temperature. Alternatively, toluene may be introduced into the reactor at reaction temperature. A flow of the olefin is then introduced into the flow of toluene before the mixture comes into contact with the catalyst bed. Regardless of the mode in which the alkylation reaction is carried out, the reactor effluent typically contains alkyltoluene, mixed with excess toluene. The excess toluene can be removed by distillation, stripping evaporation under vacuum, or other means known to those skilled in the art.

2. The Alkyl Toluene Sulfonate Salts

The alkyl toluene sulfonate salts of the present invention are represented by the general formula:

(II)

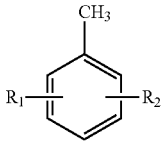

wherein $R_1$ is a metal sulfonate group, and $R_2$ is an alkyl group. Moreover, the alkyl toluene sulfonate salts of the present invention are oil-soluble.

These salts are derived from alkyl toluene sulfonic acids, which can be prepared by sulfonating the alkyl toluene precursors. Specifically, the alkyl toluene precursors described above may be sulfonated in conventional ways, such as using a $SO_3$/Air Thin Film Sulfonation method. Applying that method, the alkyl toluene precursor is mixed with a $SO_3$/Air falling film made by CHEMITHON® or BALLESTRA®.

The sulfonate salts of the present invention can be prepared by methods known to those skilled in the art. For example, they may be obtained by reacting alkyl toluene sulfonic acids with sources of suitable metals. An exemplary method comprises combining a reactive base of a metal, such as a hydroxide, with an alkyl toluene sulfonic acid. This is conventionally earned out in the presence of a hydroxylic promoter such as water; alcohols such as 2-ethyl hexanol, methanol, or ethylene glycol; and typically in an inert solvent, in which the resulting sulfonate salts may be dissolved. The reaction mixtures are typically heated. After the reactive bases of the metals are converted into the metal sulfonates, the reaction, promoters and solvents can be removed by distillation and other conventional methods.

The metals that form the alkyl toluene sulfonate salts of the present invention may be any known metals feat are capable of forming salts with alkyl toluene sulfonic acids. In a particular embodiment of the present invention, the metal is an alkali metal or an alkaline earth metal. The term "alkaline earth metal" refers to calcium, barium, magnesium and strontium. The term "alkali metal" refers to lithium, sodium, potassium, rubidium, cesium and francium. In a further embodiment of the present invention, the metal is an alkaline earth metal. In yet another specific embodiment of the present invention, the metal is calcium.

The alkyl toluene sulfonate salts of the present invention may be either neutral or overbased salts. Overbased materials are characterized by a metal content in excess of that which would be present according to the stoichiometry of the metal cation in the sulfonate said to be overbased. The term "base number" or "BN" refers to the amount of base equivalent to milligrams of KOH in one gram of sample. Thus, a higher BN reflects more alkaline products and thus a greater alkalinity reserve. The BN of samples can be determined by a variety of methods, including, for example, ASTM test No. D2896 and other equivalent procedures. The term "total base number" or "TBN" refers to the amount of base equivalent to milligrams of KOH in one gram of functional fluid. These terms are often used interchangeably with "base number" or "BN," respectively. The term "low overbased" refers to a BN or TBN of about 2 to about 60. The term "high overbased" refers to a BN or TBN of about 60 or more.

The alkyl toluene sulfonate salts of the present invention may be either neutral or overbased salts. Accordingly, they may have a TBN of about 0 to about 400. The alkyl toluene sulfonate salts of the present invention are preferably overbased to provide a TBN of about 2 to about 400, and preferably highly overbased to have a TBN of between about 60 to about 400, more preferably about 220 to about 380, and particularly preferably about 280 to about 350. An exemplary alkyl toluene sulfonate, salt of the present invention is highly overbased with a TBN of about 320.

Methods and reaction conditions for overbasing are known in the art, for example, as generally disclosed in U.S. Pat. No. 3,496,105, which is incorporated herein by reference to the extent it does not conflict with the disclosures and the claims herein. For the present invention, the overbasing may be carried out with carbon dioxide. It is believed that the carbon-dioxide treatment may lead to the formation of a colloidal dispersion of metal base. Typically, the overbased salts of the present invention are formed in the presence of methanol and xylene, and in the absence of chlorine.

The alkyl toluene sulfonate salts of the present invention are useful as additives in functional fluids in amounts sufficient to provide the desired frictional properties to the fluids, and to improve brake and clutch capacities in machines housing those fluids. Typically, at least about 0.15 wt. % of a single alkyl toluene sulfonate salt or a mixture of such salts is used in a finished functional fluid of the present invention. In various embodiments of the present invention, the amount of sulfonates in the finished functional fluid may range from, about 0.15 wt. % to about 4.0 wt. %, or from about 0.5 wt. % to about 3.5 wt. %, or from about 1.5 wt. % to about 2.5 wt. %. An exemplary finished functional fluid of the present invention comprises about 1.8 wt. % of a certain alkyl toluene sulfonate salt mixture.

The Functional Fluids

The functional fluid of the present invention comprises one or more base oils, which are present in major amounts (i.e., an amount greater than about 50 wt. %). Generally, the base oil or the mixture of base oils is present in an amount greater than about 60 wt. %, or greater than about 70 wt. %, or greater than about 80 wt. %, based on the total mass of the functional fluid. An exemplary functional fluid of the present invention comprises about 88 wt. % of a mixture of base oils.

The base oils may be derived from mineral oils, synthetic oils or vegetable oils. A base oil having a viscosity of at least about 2.5 cSt at about 40° C. and a pour point at or below about 20° C. preferably at or below about 0° C., is desirable. The base oils may be derived from synthetic or natural sources. Suitable base oils may be selected from any one or combination of Group I through Group V base stocks as defined in American Petroleum Institute Publication 1509, which is herein incorporated by reference. Suitable base oils may also include various newly developed base stocks, for example, those that are informally referred to as Group I/+, Group II/+, or Group III/+, as well, as other base stocks that are currently used by skilled persons in the art. General descriptions of these newly developed base stocks can be found in various places, for example, at Chevron's products/base oils website (www.chevron.com/products/prodserv/BaseOils/gf4_faq.shtml).

Natural base oils may include, for example, mineral oils and vegetable oils. Mineral oils suitable for use as the base oil of this invention include, for example, paraffinic, naphthenic and other oils that are ordinarily used in lubricating oil compositions. Suitable vegetable oils may include, for example, canola oil or soybean oil.

Synthetic oils of proper viscosity include, for example, hydrocarbon synthetic oils, synthetic esters, and mixtures thereof. Hydrocarbon synthetic oils may include, for example, oils prepared from the polymerization of ethylene, higher olefins, examples of which include polyalphaolefin or PAO, or from hydrocarbon synthesis procedures using carbon monoxide and hydrogen gases such as in a Fisher-Tropsch process. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used. Useful synthetic esters include esters of monocarboxylic acids and polycarboxylic acids, as well as mono-hydroxy alkanols and polyols. Typical examples are didodecyl adipate, pentacrythritol tetracaproate, di-2-ethylhexyl adipate, dilaurylsebacate, and the like. Complex esters prepared from mixtures of mono- and dicarboxylic acids and mono- and dihydroxy alkanols can also be used. Blends of mineral oils with synthetic oils are likewise potentially useful.

An exemplary functional fluid of the present invention employs a mixture of two Group 1 base oils, EXXON MOBIL® AP/E CORE™ 150N and EXXON MOBIL® AP/E CORE™ 600N.

A functional fluid of the present invention contains a friction-modifying amount of one or more alkyl toluene sulfonate salts as described herein. Typically, at least about 0.15 wt. % of one or more alkyl toluene sulfonate salts are included in a functional fluid of the present invention. Preferably, the concentration of alkyl toluene sulfonate salts in the functional fluid ranges from about 0.15 wt. % to about 4.0 wt. %, more preferably from about 0.5 wt. % to about 3.5 wt. %, and particularly preferably from about 1.5 wt. % to about 2.5 wt. %. An exemplary functional fluid of the present invention comprises about 1.8 wt. % of an alkyl toluene sulfonate salt mixture.

Besides the alkyl toluene sulfonate salts of the present invention, the functional fluid may comprise other additives as described below. These additional components can be blended in any order and can be blended as combinations of components. The fallowing additive components are provided as examples of components that may be favorably employed, without limiting the scope of the present invention.

Various dispersants may be added to the functional fluids of the present invention. Dispersants, and typically those of the ashless (metal-free) kinds are typically used in lubricants and functional fluids to maintain in suspension insoluble materials resulting from oxidation dining use, thus preventing sludge flocculation and precipitation, or deposition on metal parts. An ashless dispersant generally comprises an oil-soluble polymeric hydrocarbon backbone having functional groups that are capable of associating with particles to be dispersed. Many types of ashless dispersants are known in the art, including amines, alcohols, amides, or ester polar moieties attached to the polymer backbones via bridging groups. The ashless dispersants of the present invention may be chosen from, for example, oil-soluble salts, esters, amino-esters, amides, imides, and oxazolines of long-chain hydrocarbon-substituted mono and dicarboxylic acids or their anhydrides, thiocarboxylate derivatives of long-chain hydrocarbons, long-chain aliphatic hydrocarbons having a polyamine attached directly thereto; and Mannich condensation products formed by condensing a long-chain substituted phenol with formaldehyde and polyalkylene polyamine. Examples of suitable ashless dispersants may include "carboxylic dispersants," which are reaction products of carboxylic acylating agents (acids, anhydrides, esters, etc.) comprising at least 34 and preferably at least 54 carbon atoms with nitrogen-containing compounds (such as amines), organic hydroxyl compounds (such as aliphatic compounds including monohydric and polyhydric alcohols, or aromatic compounds including phenols and nephthols), and/or basic inorganic materials. Succinimide dispersants are a species of carboxylic dispersants, which may be produced by reacting hydrocarbyl-substituted succinic acylating agent with organic hydroxyl compounds, or with amines comprising at least one hydrogen atom attached to a nitrogen atom, or with a mixture of the hydroxyl compounds and amines. Examples of suitable ashless dispersants also include, for example, amine dispersants, which are reaction products of relatively high molecular weight aliphatic halides and amines, preferably polyalkylene polyamines. Examples thereof have been described, for example, in U.S. Pat. Nos. 3,275,554, 3,438,757, 3,454,555, 3,565,804, and the like. Examples of suitable dispersants also include, for example, "Mannich dispersants," which are the reaction products of alkyl phenols in which the alkyl group contains at least 30 carbon atoms with aldehydes (especially formaldehyde) and amines (especially polyalkylene polyamines). These dispersants have been described, for example, in U.S. Pat. Nos. 3,036,003, 3,586,629, 3,591,598, 3,980,569, and the like. Suitable ashless dispersants may even include post-treated dispersants, which can be obtained by reacting carboxylic, amine or Mannich dispersants with reagents such as dimercaptothiazoles, urea, thiourea, carbon disulfide, aldehydes, ketones, carboxylic acids, hydrocarbon-substituted succinic anhydrides, nitrile epoxides, boron compounds and the like. Post-treated dispersants have been described, for example, in U.S. Pat. Nos. 3,329,658, 3,449,250, 3,666,730, and the like. Suitable ashless dispersants may also include polymeric dispersants, such as those described in, for example, U.S. Pat. Nos. 3,329,658, 3,449, 250, 3,666,730, and the like. The disclosures of the herein patents, to the extent they do not conflict with the disclosures and claims herein, are incorporated in their entirely by reference.

Metal-containing detergents may be added, to the functional fluids of the present invention. Such detergents may include, for example, sulfurized or unsulfurized alkyl or alkenyl phenates, sulfonates derived from synthetic or natural feedstocks, carboxylates, salicylates, phenalates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and chemical or physical mixtures thereof. Such metal-containing detergents may be overbased or neutral. Overbased metal-containing detergents may be high-overbased or low-overbased.

Antioxidants are optionally added to the functional fluids to reduce the tendency of mineral oils to deteriorate in service. Such deterioration may otherwise lead to deposits of sludge and varnish-like debris on metal surfaces. The oxidation deterioration may also lead to an unacceptable increase in viscosity in the fluids, impairing the performance of the machines that house the functional fluid, and/or damaging the relatively moving and coupling parts. Many antioxidants are known in the art, including, for example, phenol-type (phenolic) oxidation inhibitors, such as 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butylphenol), 4,4'-butyldene-bis(3-methyl-6-tert-butyl phenol), 4,4'-isopropylidene-bis(2,6-di-tert-butylphenol), 2,2'-methylene-bis(4-methyl-6-nonylphenol), 2,2'-isobutylidene-bis(4,6-dimethylphenol), 2,2'-methylene-bis(4-methyl-6-cyclohexylphenol), 2,6-di-tert-butyl-4-ethylphenol, 2,4-dimethyl-6-tert-butyl-phenol, 4,4'-thiobis(2-methyl-6-tert-butylphenol), 2,2'-thiobis(4-methyl-6-tert-butylphenol), and bis(3,5-di-tert-butyl-4-hydroxybenzyl). Antioxidants may also be of the diphenylamine-type, which include, for example, alkylated diphenylamine, phenyl-α-naphthylamine, and alkylated-α-naphthylamine. Other types of oxidation inhibitors may include, for example, metal dithiocarbamate (e.g., zinc dithiocarbamate), methylene bis-(dibutyldithiocarbamate), and the like.

One or more anti-wear/extreme pressure agents may be included in the functional fluid compositions of the present invention, especially when the fluids are blended for use in heavy-duty machines such as farm tractors. As their name implies, these agents reduce wear of moving metallic parts. Examples of such agents include phosphates, carbamates, esters, sulfur-containing compounds, molybdenum complexes, zinc dialkyldithiophosphate (primary alkyl-, secondary alkyl-, and aryl-types), sulfurized oils, sulfurized isobutylene, sulfurized polybutene, methyl trichlorostearate, chlorinated naphthalene, fluoro-alkylpolysiloxane, and lead naphthenate.

One or more rust inhibitors may also be added to the functional fluid. These agents typically fall into two broad categories: nonionic polyoxyethylene surface active agents, and other compounds. Nonionic polyoxyethylene surface active agents include, for example, polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol, monostearate, and polyethylene glycol monooleate. Other rust-inhibiting compounds include, for example, stearic acid and other fatty acids, dicarboxylic acids, metal soaps, fatty acid amine salts, metal salts of heavy sulfonic acid, partial carboxylic acid ester of polyhydric alcohol, and phosphoric ester.

It is not uncommon to include demulsifiers in functional fluids, especially when such fluids are used in environments where water contamination is prevalent or inevitable. Typical demulsifiers include, for example, the addition product of alkylphenol and ethylene oxide, polyoxyethylene alkyl ether, and polyoxyethylene sorbitan ester.

In addition to the friction-modifying amount of alkyl toluene sulfonate salts, the functional fluids of the present invention may optionally comprises one or more other friction modifiers. These other friction modifiers may be selected from, for example, fatty alcohols, 1,2-diols, borated 1,2-diols, fatty acids, amines, fatty acid amides, borated esters, and other esters.

As it is known in the art, many additives are multifunctional. For example, a particular compound may be included in the lubricating fluid to provide dispersancy in addition to antiwear properties. Suitable multifunctional additives include, for example, sulfurized oxymolybdenum dithiocarbamate, sulfurized oxymolybdenum organo phosphorodithioate, oxymolybdenum, monoglyceride, oxymolybdenum diethylate amide, amine-molybdenum complex compound, and sulfur-containing molybdenum complex compound.

A functional fluid of the present invention may optionally include one or more viscosity index improvers. They include, for example, polymethacrylate-type polymers, ethylene-propylene copolymers, styrene-isoprene copolymers, hydrogenated styrene-isoprene copolymers, polyisobutylene, and dispersant-type viscosity index improvers.

For certain applications, a functional, fluid of the present invention may also include one or more pour point depressants, including, for example, polymethyl methacrylate.

Moreover, a functional fluid of the present invention may comprise one or more foam inhibitors. Suitable foam inhibitors include, for example, alkyl methacrylate polymers, dimethyl silicone polymers, and like molecules.

The functional fluid compositions of the present invention are formulated by known methods. The formulation is typically carried out at the additive manufacturing plant or blending facility, but the compositions can also be formulated by hand.

Often all the additives, except for the viscosity index improvers and pour point depressants, are blended into a concentrate or additive package that is subsequently blended into base stock to make finished fluids. Use of such concentrates is conventional and well known. The concentrates are formulated to contain the additives in proper amounts so as to provide the desired concentration in the final formulation when the concentrate is combined with a predetermined amount of base oils.

Chloride Compatibility

There may be occasionally a need to use the friction modifying agents and functional fluids of the present invention in the presence of certain amounts of chloride ions. For example, the process to manufacture alkyl toluene sulfonate salts may itself introduce chloride ions into the environment wherein a friction modifying agent of the present invention is used because one or more chloride-containing compounds may be added to modify viscosity during that process. Having a class of friction modifying agents that can be used in the presence of chloride ions is therefore desirable as such friction modifying agents can be used without necessarily removing the chloride ions.

The friction-modifying capacities of the alkyl toluene sulfonate salts and functional fluids of the present invention are not substantially diminished in the presence of chloride ions. Accordingly, other additives and the base oils in these functional fluids are likewise compatible with the presence of chloride. Typically, the friction-modifying capacities of the alkyl toluene sulfonate salts and functional fluids of the present invention are not substantially diminished in the presence of up to about 10 ppm, preferably up to about 20 ppm, and particularly preferably up to about 50 ppm of chloride ions. In an exemplary embodiment, the presence of about 50 ppm of chloride does not substantially diminish the friction-modifying capacity of a certain functional fluid prepared according to the specifications of the present invention. For purposes of the present invention, the term "not substantially diminish" refers to a reduction of not more than 5%, 10%, 20%, or 30% of friction-modifying capacity. Accordingly, chloride ions are said to not substantially diminish the friction-modifying capacity of a certain alkyl toluene sulfonate salt/mixture or a functional fluid when its friction-modifying capacity in the presence of chloride is at least about 70%, about 80%, about 90%, or about 95%, of its friction-modifying capacity in the absence of chloride.

This invention will be further understood by reference to the following examples, which are not to be considered as limitative of its scope.

EXAMPLES

The following examples are provided to illustrate the present invention without limiting it. While the present invention has been described with reference to specific embodiments, this application is intended to encompass those various changes and substitutions that may be made by those skilled in the art without departing from the spirit and scope of the appended claims.

Example 1

Improving Static Breakaway Friction Values

Various finished functional fluid samples were prepared. Their friction-modifying capacities were measured in a static breakaway friction bench test designed to simulate the conditions under which a set of wet brakes or wet clutches may operate. The device in which the tests were carried out comprised a brake disc, which was lubricated in an open oil sump with Functional Fluid Samples 1 to 10 and Comparative Functional Fluid A, which are listed below in Table 3. The device further comprised friction pads, which were in contact with the brake disc, and a shaft that rotated the brake disc. During each test, a certain level of pressure was applied on the friction pads, and an electric motor drove the shaft to rotate while the brake disc, was held in its original position. At a particular pressure level, a reading of maximum resisting torque reached within 0.25 seconds after the shaft starts to rotate was recorded. Ten of these 0.25-second cycles were carried out at each pressure level. An average was taken from the 10 maximum torque readings, yielding a 10-round average maximum torque, which was then divided by the level of pressure to arrive at a static breakaway friction value.

The Negative Control Sample comprised an alkyl benzene sulfonate instead of an alkyl toluene sulfonate mixture of the present invention, in an amount that provided the same concentration of $Ca^{2+}$ as in the Functional Fluid Samples and Comparative Fluid Sample A. The increase in static breakaway friction values were determined by subtracting the static breakaway friction values of the Negative Control Sample [Y] from the values of the Functional Fluid Samples and Comparative Fluid Sample A [X]. Functional Fluid Samples 1 to 10 and Comparative fluid Sample A exhibited significant increase in static breakaway friction values.

Olefins of various branching/isomerization levels (Olefins I to VIII in Table 1) were mixed to prepare the alkylation agents (the "olefin mixes" in Table 2). These olefin mixes were then used to prepare alkyl toluenes (ATs I to X in Table 2). To prepare the Comparative Package A, non-isomerized Olefin(comp) (Table 1) was used to alkylate toluene, yielding AT(comp) (Table 2). To prepare the Negative Control package, the same, non-isomerized Olefin(comp) (Table 1), was used to alkylate benzene, yielding AB(–) (Table 2). These alkylated precursors were sulfonated by conventional methods such as the $SO_3$/Air Thin Film Sulfonation method described herein. The sulfonation products were then introduced to additive packages at concentrations that would provide about the same amount of $Ca^{2+}$ to the fluids. Other components of the additive packages are also listed in Table 2.

All sulfonation products, including the ones comprising the AB(–) and the AT(comp), were highly overbased to give a TBN of about 320.

TABLE 1

The Olefins

| Olefin # | Carbon Numbers | Branching Levels | Alpha-Olefin Concentrations |
|---|---|---|---|
| Olefin I | 20-24 | 20.4% | 12.1% |
| Olefin II | 20-26 | 54.8% | 1.6% |
| Olefin III | 20-24 | 25.0% | 1.1% |
| Olefin IV | 20-26 | 23.4% | 31.9% |
| Olefin V | 20-24 | 21.2% | 5.6% |
| Olefin VI | 20-24 | 17.5% | 12.0% |
| Olefin VII | 20-26 | 20.7% | 11.7% |
| Olefin VIII | 20-26 | 0 | Non-isomerized |
| Olefin(comp) | 20-24 | 0 | Non-isomerized |

TABLE 2

The Alkylation Agents & Friction Modifying Agents Packages

| Additive Package # | Sulfonate (wt. %) | AT # | Olefin mixes | Branch (%) | Optional Components |
|---|---|---|---|---|---|
| 1 | 1.8 | I | 80% Olefin I<br>20% Olefin II | 27.3 | Examples** of optional components that can be |
| 2 | 1.8 | II | 80% Olefin I<br>20% Olefin IV | 21.0 | favorably employed in the packages, selected from one or |
| 3 | 1.8 | III | 80% Olefin III<br>20% Olefin II | 31.0 | more of:<br>a) antioxidants; |
| 4 | 1.8 | IV | 80% Olefin III<br>20% Olefin IV | 24.7 | b) anti-wear/extreme pressure agents; |
| 5 | 1.8 | V | 100% Olefin V | 21.2 | c) detergents |
| 6 | 1.8 | VI | 80% Olefin V<br>20% Olefin VIII | 17.0 | d) rust inhibitors;<br>e) non-alkyl toluene sulfonate |

TABLE 2-continued

The Alkylation Agents & Friction Modifying Agents Packages

| Additive Package # | Sulfonate (wt. %) | AT # | Olefin mixes | Branch (%) | Optional Components |
|---|---|---|---|---|---|
| 7 | 1.8 | VII | 100% Olefin VI | 17.5 | friction modifiers; |
| 8 | 1.8 | VIII | 90% Olefin VI<br>10% Olefin VIII | 15.8 | f) multi-functional additives;<br>g) foam inhibitors; |
| 9 | 1.8 | IX | 80% Olefin VI<br>20% Olefin VIII | 14.0 | h) demulsifiers;<br>i) dispersants; |
| 10 | 1.8 | X | 100% Olefin VII | 20.7 | j) seal conditioning agents |
| Comp. Pack. A | 1.8 | AT (comp) | Olefin(comp) | 0 | |
| Negative Control Package | 1.9* | AB(—) | Olefin(comp) | 0 | |

*The alkyl benzene sulfonate in the Negative Control package (i.e., 1.9 wt. %) provided an equivalent amount of $Ca^{2+}$ to the package as did the alkyl toluene sulfonates in the other packages (i.e., 1.8 wt. %).
**The optional components listed in this column are merely examples of the type of components that can be employed for purpose of the present invention. They are listed herein to illustrate the claimed invention without limiting it.

The Additive Packages of Table 2 were further blended with a certain mixture of base oils, one or more viscosity improvers, and one or more pour point depressants. The finished functional fluids and their components are listed in Table 3.

TABLE 3

Components of the Finished Functional Fluids

| Functional Fluid # | Additive Package (6.85 wt. %) | Other Components | |
|---|---|---|---|
| 1-10 | 1-10 | Viscosity Index Improver | 4.75 wt. % |
| Comp. | Comp. | Pour Point Depressant | 0.20 wt. % |
| Functional | Pack. A | EXXON MOBIL ® AP/E Core ™ 150N | 54.70 wt. % |
| Fluid A | | EXXON MOBIL ® AP/E Core ™ 600N | 33.50 wt. % |

Static breakaway friction values were determined. Each sample or comparative sample (value [X]) was measured in parallel with a negative control sample (value [Y]) to account for experimental variability. The results for Functional Fluid samples 1 to 10 and Comparative Functional Fluid A are listed in Table 4.

TABLE 4

Test Results

| Sample # | Static Breakaway Friction Values ($mm^3$) = [X] | Static Breakaway Friction of Negative Control ($mm^3$) = [Y] | Increase in Static Breakaway Friction Values ($mm^3$) = [X] − [Y] |
|---|---|---|---|
| 1 | 17463 | 17010 | 453 |
| 2 | 17617 | 17010 | 607 |
| 3 | 17653 | 17010 | 643 |
| 4 | 17340 | 17010 | 330 |
| 5 | 17869 | 17110 | 759 |
| 6 | 17364 | 16924 | 440 |
| 7 | 17951 | 16881 | 1070 |
| 8 | 16555 | 15965 | 590 |

TABLE 4-continued

Test Results

| Sample # | Static Breakaway Friction Values ($mm^3$) = [X] | Static Breakaway Friction of Negative Control ($mm^3$) = [Y] | Increase in Static Breakaway Friction Values ($mm^3$) = [X] − [Y] |
|---|---|---|---|
| 9 | 16923 | 15965 | 958 |
| 10 | 16638 | 15965 | 673 |
| Comp. Functional Fluid A | 17766 | 17441 | 325 |

Example 2

Chloride Compatibility

Chloride compatibility of a friction modifying agent, i.e., an alkyl toluene sulfonate salt made from alkyl toluene precursor (AT) XI, and a functional fluid, i.e., Functional Fluid Sample 11, was determined using Comparative Functional Fluid B. Components of these samples are listed in Table 5. Alkyl toluene precursor (AT) XI had a branching level of about 20.7% and an alpha olefin content of about 11.7%.

A static breakaway value of a Negative Control fluid comprising a $Ca^{2+}$-equivalent amount of alkyl benzene sulfonate instead of alkyl toluene sulfonate was obtained in parallel with Functional Fluid Sample 11 and Comparative Functional Fluid B. This value was then subtracted from the static breakaway values of the samples to yield the "static breakaway friction increases" results in Table 5.

Functional Fluid Sample 11 and Comparative Functional Fluid B both showed higher breakaway friction values than the Negative Control fluid, suggesting that these fluids both had improved frictional properties. The presence of chloride in Fluid Sample 11 did not substantially diminish the friction-modifying capacity of the alkyl toluene sulfonate salts in that fluid.

TABLE 5

| Functional Fluid Sample 11 | Comparative Functional Fluid B |
|---|---|
| 1.8 wt. % AT sulfonate XI (20.7% branched) Package may also optionally comprise one or more of the following components: * | 1.8 wt. % AT sulfonate XI (20.7% branched) Package comprises the same optional components as in Functional Fluid Sample 11 and at the same |

TABLE 5-continued

| Functional Fluid Sample 11 | Comparative Functional Fluid B |
|---|---|
| a) antioxidants; | concentrations, which may be one or more |
| b) anti-wear/extreme pressure agents; | selected from: * |
| c) rust inhibitors; | a) antioxidants; |
| d) detergents; | b) anti-wear/extreme pressure agents; |
| e) non-alkyl toluene sulfonate friction modifiers; | c) rust inhibitors; |
| f) foam inhibitors | d) detergents; |
| g) dispersants; | e) non-alkyl toluene sulfonate friction modifiers; |
| h) demulsifiers; | f) foam inhibitors |
| i) multi-functional additives; and | g) dispersants; |
| j) seal conditioning agents. | h) demulsifiers; |
| 50 ppm $Cl^-$ | i) multi-functional additives; and |
| Other components in the functional fluid: | j) seal conditioning agents. |
| a) 0.20 wt. % pour point depressant | 0 ppm $Cl^-$ |
| b) 4.75 wt. % viscosity index improver | Other components in the functional fluid: |
| c) ~88 wt. % EXXON MOBIL ® AP/E CORE ™ | a) 0.20 wt. % pour point depressant |
| Base Oils (mixed) | b) 4.75 wt. % viscosity index improver |
| Static Breakaway Friction Increase = 1346 $mm^3$ | c) ~88 wt. % EXXON MOBIL ® AP/E CORE ™ |
| | Base Oils (mixed) |
| | Static Breakaway Friction Increase = 673 $mm^3$ |

* The following is a non-limiting list of optional components that may be favorably employed.

What is claimed is:

1. A functional fluid composition comprising an admixture of: (a) a major amount of an oil of lubricating viscosity; and (b) a friction-modifying amount of one or more oil-soluble alkyl toluene sulfonate salts represented by the formula:

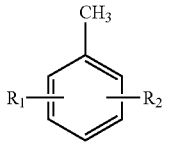

wherein $R_1$ is a metal sulfonate group and $R_2$ is an alkyl group derived from $C_{20}$-$C_{24}$ isomerized linear alpha olefins, wherein about 14% to about 31% of each of the isomerized linear olefins are branched, and further wherein the friction-modifying amount of one or more oil-soluble alkyl toluene sulfonate salts in the functional fluid is about 1.5 wt. % to about 2.5 wt. %.

2. The functional fluid composition of claim 1, wherein the one or more alkyl toluene sulfonate salts are chosen from alkali metal salts and alkaline earth metal salts.

3. The functional fluid composition of claim 2, wherein the one or more alkyl toluene sulfonate salts are alkaline earth metal salts.

4. The functional fluid composition of claim 3, wherein the one or more alkyl toluene sulfonate salts are calcium salts.

5. The functional fluid composition of claim 1, wherein the one or more alkyl toluene sulfonate salts are overbased salts.

6. The functional fluid composition of claim 5, wherein the one or more alkyl Ilene sulfonate salts are overbased with carbon dioxide.

7. The functional fluid composition of claim 1, wherein each of the one or more alkyl toluene sulfonate salts has a total base number of about 0 to about 400.

8. The functional fluid composition of claim 5, wherein each of the overbased salts has a total base number of about 60 to about 400.

9. The functional fluid composition of claim 8, wherein each of the overbased salts has a total base number of about 250 to about 380.

10. The functional fluid composition of claim 9, wherein each of the overbased salts has a total base number of about 300 to about 350.

11. The functional fluid composition of claim 1, wherein the one or more alkyl toluene sulfonate salts are derived from alkyl toluene precursors prepared by reacting isomerized linear olefins with toluene.

12. The functional fluid composition of claim 1, wherein about 0.5% to about 50% of each of the isomerized linear olefins are alpha olefins.

13. The functional fluid composition of claim 12, wherein about 1.5% to about 35% of each of the isomerized linear olefins are alpha olefins.

14. The functional fluid composition of claim 1, further comprising one or more additives selected from the group consisting of (1) antioxidants; (2) rust inhibitors; (3) demulsifiers; (4) friction modifying agents other than alkyl toluene sulfonates; (5) viscosity index improvers; (6) multi-functional additives; (7) dispersants; (8) anti-wear/extreme pressure agents; (9) pour point depressants; (10) foam inhibitors; (11) detergents; and (12) seal conditioning agents.

15. The functional fluid composition of claim 1, wherein the friction-modifying capacity of the composition is not substantially diminished in the presence of chloride ions.

16. The functional fluid composition of claim 15, wherein the friction-modifying capacity of the composition is not substantially diminished in the presence of up to about 10 ppm of chloride.

17. The functional fluid composition of claim 16, wherein the friction-Modifying capacity of the composition is not substantially diminished in the presence of up to about 50 ppm of chloride.

18. A method of achieving optimal frictional characteristics and maintaining such characteristics in a machine comprising relatively moving and coupling parts, the method comprising: (a) immersing at least some of the surfaces of the relatively moving and coupling parts in a functional fluid of claim 1; and (b) operating the machine in the presence of the functional fluid.

19. The method according to claim 18, wherein the functional fluid is a tractor fluid, a tractor hydraulic fluid, a transmission fluid, or a hydraulic fluid.

20. The method according to claim 19, wherein the functional fluid is a tractor hydraulic fluid.

21. The method of claim 18, wherein the functional fluid further comprising one or more additives selected from the group consisting of (1) antioxidants; (2) demulsifiers; (3) rust inhibitors; (4) friction modifying agents that are not alkyl toluene sulfonates; (5) pour point depressants; (6) viscosity index improvers; (7) foam inhibitors; (8) multi-functional additives; (9) anti-wear/extreme pressure agents; (10) dispersants; (11) detergents; and (12) seal conditioning agents.

22. A method of making a functional fluid composition comprising blending the following components; (a) an oil of lubricating viscosity; and (b) one or more oil-soluble alkyl toluene sulfonate salts represented by the formula:

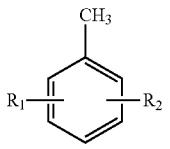

wherein $R_1$ is a metal sulfonate group and $R_2$ is an alkyl group derived from $C_{20}$-$C_{24}$ isomerized linear alpha olefins, wherein about 14% to about 31% of each of the isomerized linear olefins are branched, and further wherein the friction-modifying amount of one or more oil-soluble alkyl toluene sulfonate salts in the functional fluid is about 1.5 wt. % to about 2.5 wt. %.

23. The method according to claim 22, further comprising blending one or more additives selected from the group consisting of: antioxidants; rust inhibitors; friction modifying agents that are not alkyl toluene sulfonates; viscosity index improvers; demulsifiers; pour point depressants; anti-wear/extreme pressure agents; multi-functional additives; foam inhibitors; detergents; seal conditioning agents; and dispersants into the functional fluid composition.

24. The functional fluid composition according to claim 1, wherein the functional fluid is a tractor fluid, a tractor hydraulic fluid, a transmission fluid, or a hydraulic fluid.

* * * * *